US005445530A

United States Patent [19]

Inoue et al.

[11] Patent Number: 5,445,530

[45] Date of Patent: Aug. 29, 1995

[54] LEVER-TYPE CONNECTOR

[75] Inventors: Nori Inoue; Hitoshi Okumura; Youichi Nankoh; Hiroyuki Nakata, all of Yokkaichi, Japan

[73] Assignee: Sumitomo Wiring Systems, Mie, Japan

[21] Appl. No.: 172,230

[22] Filed: Dec. 22, 1993

[30] Foreign Application Priority Data

Dec. 24, 1992 [JP] Japan ..... 4-093156 U

[51] Int. Cl.[6] ..... H01R 13/62

[52] U.S. Cl. ..... 439/157; 439/160

[58] Field of Search ..... 439/157, 153, 160

[56] References Cited

U.S. PATENT DOCUMENTS 4,586,771 5/1986 Kraemer et al. .

5,135,410 8/1992 Kawase et al. ..... 439/157

5,269,696 12/1993 Okada et al. ..... 439/160

5,308,255 5/1994 Yamanashi ..... 439/157

5,330,411 7/1994 Fujitani et al. ..... 439/157

FOREIGN PATENT DOCUMENTS 4-62772 2/1992 Japan .

2179506 3/1987 United Kingdom .

*Primary Examiner*—Mark Rosenbaum

*Assistant Examiner*—Jeffrey T. Knapp

*Attorney, Agent, or Firm*—Oliff & Berridge

[57] ABSTRACT

A lever includes regulating projections, whereas guide grooves are formed in outer walls of a male connector housing. If the lever is inserted into the male connector housing with force when the former is mounted on the latter, the regulating projections abut against the bottoms of the guide grooves to stop the entrance of the lever. As a result, erroneous entrance of lever support shafts into cam grooves is avoided.

10 Claims, 5 Drawing Sheets

LEVER-TYPE CONNECTOR

BACKGROUND OF THE INVENTION

This invention relates to a lever-type connector in which connectors are connected together through leverage, and more particularly, to a lever-type connector with an improved assembling operability.

A connector of this type has an advantage that the connection and disconnection can be effected with a small force, and this concept has been applied particularly to multi-pole connectors. Its basic principle is based on the action of a lever, and a conventional construction disclosed, for example, in Japanese Patent Unexamined Publication No. 4-62772 is broadly shown in FIGS. 5(A)-(D).

In FIGS. 5(A)-(D), a female connector housing 1 in which female terminals are to be accommodated and a male connector housing 2 in which male terminals are to be accommodated are shown. The female connector housing 1 can be inserted into the male connector housing 2. The male connector housing 2 has a lever 3 having cam grooves 3*a* mounted so as to be pivotable about support shafts 2*a*. On the female connector housing 1 side are cam follower projections 4*a*. The cam follower projections 4*a* are arranged on a cover 4 that is to be put on the female connector housing 1. The lever 3 is of a two-leg structure and has bearing holes 3*b* close to the cam grooves 3*a*, respectively. The lever 3 is supported so as to be pivotable relative to the male connector housing 2 by causing the lever support shafts 2*a* to be engaged with the bearing holes 3*b*. The lever support shafts 2*a* are formed on and projected from the male connector housing 2.

The operation of connecting both connector housings 1, 2 is as follows. As shown in FIG. 5(B), the cam follower projections 4*a* on the cover 4 mounted on the female connector housing 1 are inserted into the cam grooves 3*a* on the lever 3, respectively. The lever 3 is turned in a direction indicated by the arrow in FIG. 5(B) through the position shown in FIG. 5(C) to that shown in 5(D). As a result, the cam follower projections 4*a* and hence the cover 4 are pressed downward by the action of the cams of the cam grooves 3*a* as viewed in FIG. 5(D). This causes the female connector housing 1 to be inserted into the male connector housing 2 completely, thereby connecting the terminals accommodated in both connector housings to one another.

For mounting the lever 3 on the male connector housing 2, the following steps will be taken. First, holding the male connector housing 2 in one hand and the lever 3 in the other, leg portions 3*c* of the lever 3 are put on the lever support shafts 2*a* of the male connector housing 2 as shown in FIG. 6(A). Then, in this condition, the lever 3 is pushed onto the male connector housing 2 with sufficient force to cause the leg portions 3*c* to deform elastically so that they open apart from each other to allow the lever 3 to enter. When the bearing holes 3*b* formed in the leg portions 3*c* meet the lever support shafts 2*a*, respectively, both are engaged with each other, allowing the lever 3 to be pivotally mounted on the male connector housing 2.

However, for elastically opening the leg portions 3*c* of the lever 3, the lever 3 is pushed down with a comparatively strong force. As a result, at the moment in which both leg portions 3*c* of the lever 3 have opened by such strong force, the lever 3 itself enters with force. Even if the bearing holes 3*b* of the lever 3 meet the lever support shafts 2*a*, such strong force causes the lever 3 to continuously be driven farther, leaving the lever support shafts 2*a* unengaged with the bearing holes 3*b*. As a result, the lever support shafts 2*a* can be erroneously inserted into the cam grooves 3*a* as shown in FIG. 6(C).

Once this has happened, the cam grooves 3*a* must be engaged with the lever support shafts 2*a* again by taking the cam grooves 3*a* out of the lever support shafts 2*a*, which is a cumbersome operation.

SUMMARY OF THE INVENTION

The invention has been made in view of the above circumstances, Accordingly, an object of the invention is to provide a lever-type connector that can prevent cam follower projections from entering into bearing holes in a lever and that can be assembled easily and surely to ensure improved assembly.

These and other objects are achieved by providing a lever-type connector, wherein a lever having cam grooves is pivotally mounted between a first connector housing and a second connector housing. The second connector housing includes at least one cam follower projection, wherein the first connector includes a rectangular hood disposed substantially about the said first connector housing, at least one lever support shaft projecting laterally from the rectangular hood, the lever being mounted on the at least one lever support shaft, outer walls spaced from and outside of lateral walls of the first connector, the lever being mounted between the outer walls and the lateral walls, and structure for preventing the at least one lever support shaft from engaging a respective one of the cam grooves.

The preventing structure may include at least one regulating projection attached to the lever and a guide groove having a predetermined depth formed in each of the outer walls, the guide groove receiving the at least one regulating projection.

In the thus constructed lever-type connector, the regulating projections arranged on the lever enter into the guide grooves formed on the outer walls of the connector housing when the lever is fitted into the connector housing. The length of the guide groove is set to cause the regulating projection to abut against the bottom of the guide groove at a stage after the lever support shaft has passed the bearing hole in the lever and before the lever support shaft enters into the cam groove. Therefore, even if the lever is inserted with force, the regulating projections abut against the bottoms of the guide grooves to stop the lever from entering further, which keeps the lever support shafts from entering into the cam grooves.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

An embodiment of the present invention will now be described with reference to FIGS. 1 to 4.

Figure 4:
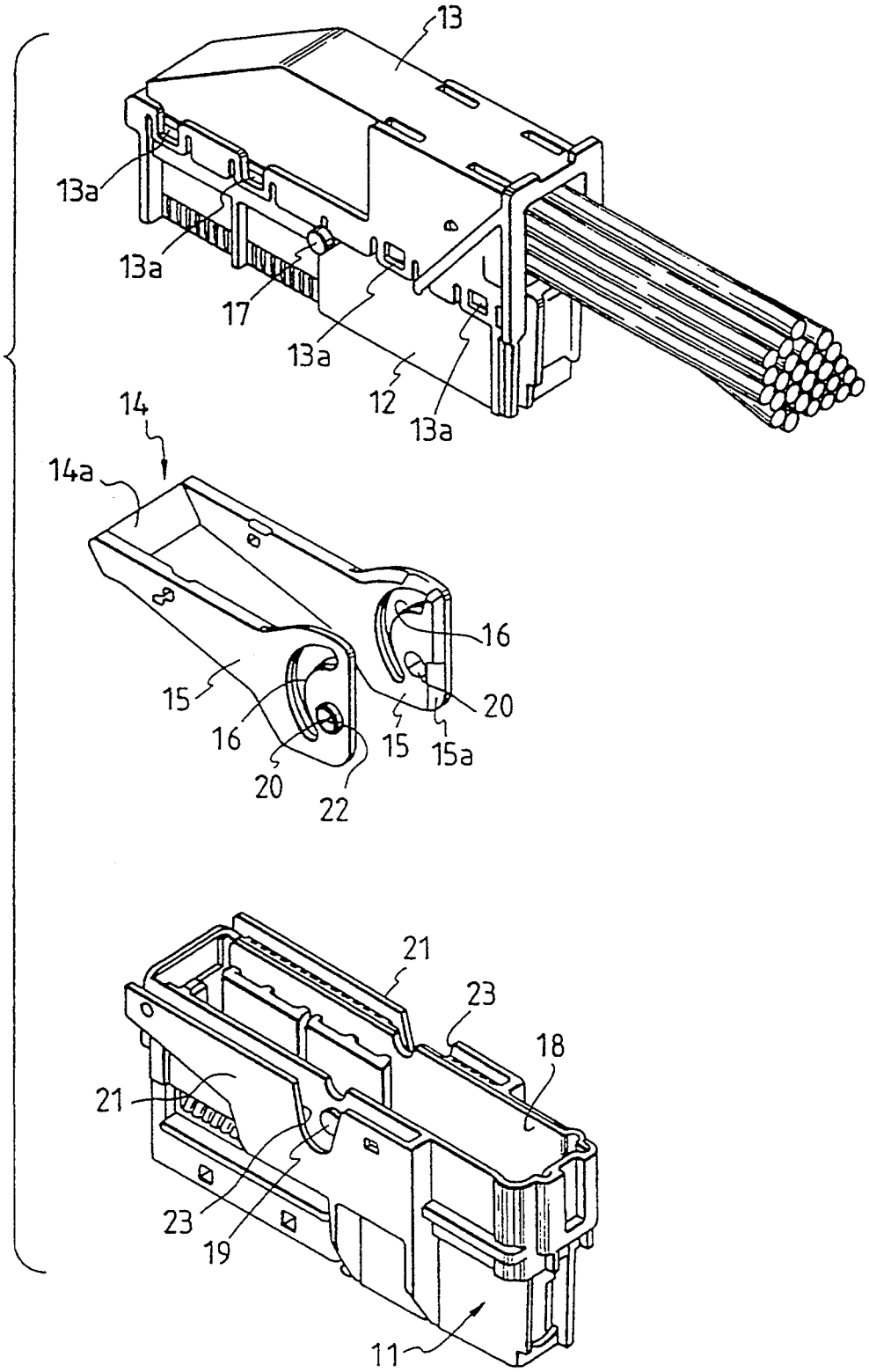
FIG. 4 is a perspective view showing an overall structure of the embodiment.
Figure 5A:
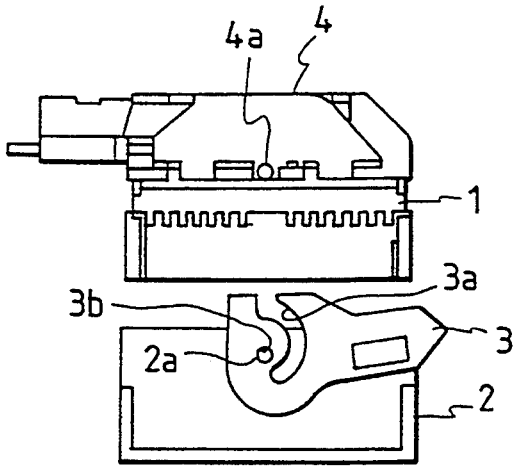
FIG. 5A PRIOR ART
FIGS. 5(A) to (D) are side views broadly showing the construction of a lever-type connector.
Figure 5B:
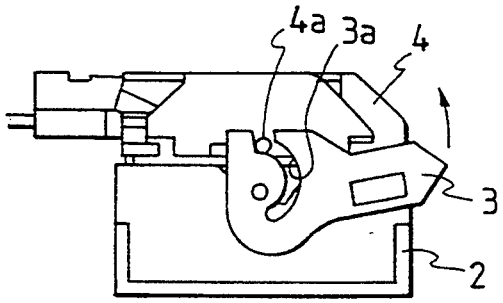
FIG. 5B PRIOR ART
Figure 5C:
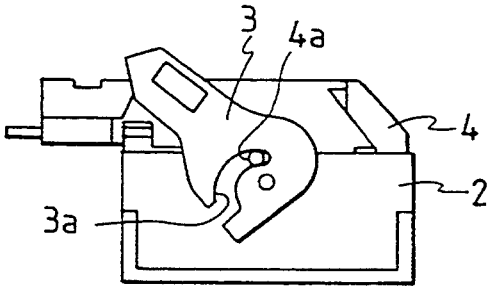
FIG. 5C PRIOR ART
Figure 5D:
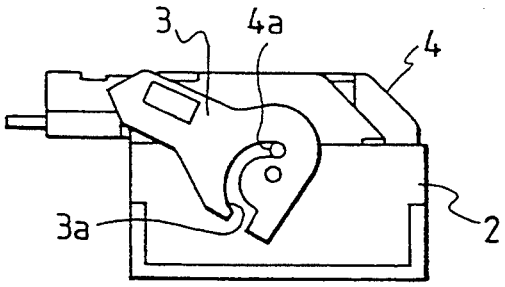
FIG. 5D PRIOR ART
Figure 6A:
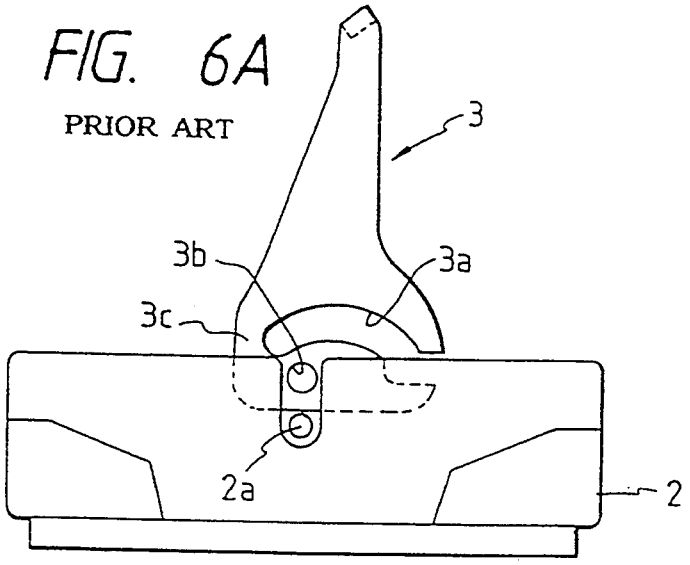
FIG. 6A PRIOR ART
FIGS. 6(A) to (C) are side views showing problems encountered when a lever is assembled in a conventional construction.
Figure 6B:
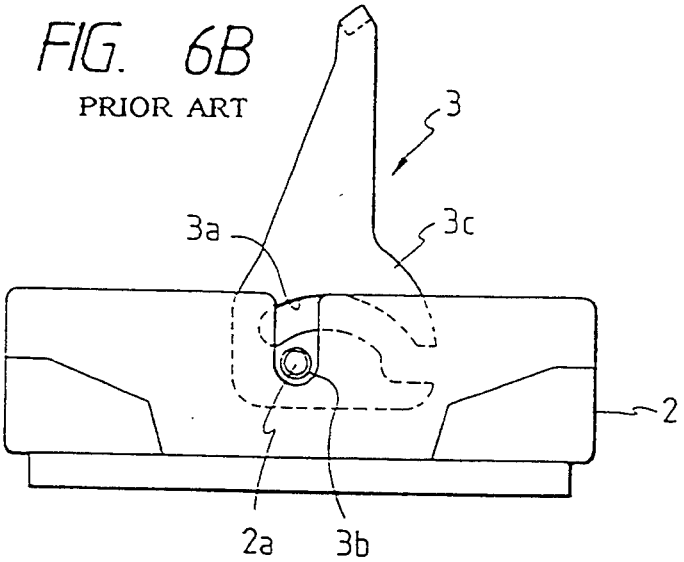
FIG. 6B PRIOR ART
Figure 6C:
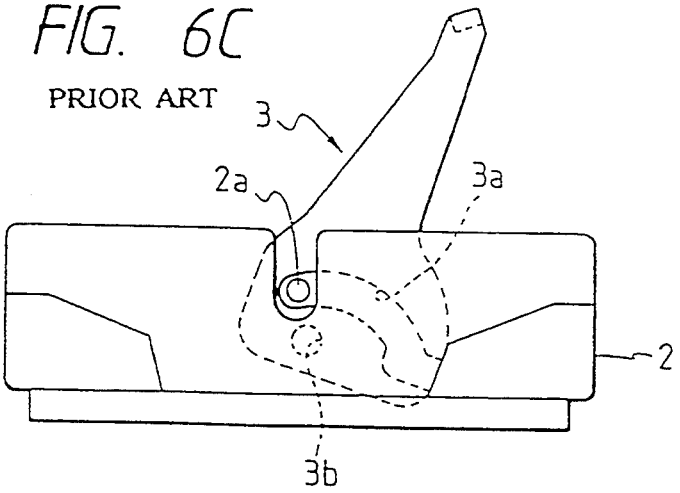
FIG. 6C PRIOR ART

FIG. 4 shows an overall structure. A male connector housing 11 into which male terminals (not shown) are to be inserted is shown in the lower side, whereas a female connector housing 12 into which female terminals are inserted is shown in the upper side.

On top of the female connector housing 12 is a cover 13, which is designed to entirely cover the upper surface of the female connector housing. The cover 13 is engaged with the female connector housing 12 by an engaging mechanism 13*a*. Cam follower projections 17 are formed on and are projected laterally in the middle of lateral walls of the female connector housing 12. The cam follower projections 17 are designed to be engaged with cam grooves 16 formed on a lever 14, which will be described later.

The male connector housing 11 has a rectangular hood 18, whose top surface is open. A pair of lever support shafts 19 project laterally from side walls of the hood 18. The lever 14, which has been referred to above, is mounted on shafts 19 and is of a two-leg structure. The upper ends of the respective leg portions 15, right and left, are connected to each other by a bridge portion 14*a*. Each leg portion 15 has a bearing hole 20 into which the corresponding lever support shaft 19 is inserted. Further, the lower end of each leg portion 15 is tapered to form a tapered surface 15*a*. Surfaces 15*a* are tapered toward the inside of the lever 14. Each leg portion 15 has the cam groove 16 engageable with the corresponding cam follower projection 17 that is projected from the cover 13. By turning the lever 14 with the cam follower projections 17 engaged with the cam grooves 16, respectively, the cover 13, and hence the female connector housing 12, are displaced toward the male connector housing 11 by the action of the cams, thereby connecting and disconnecting both connectors. On both lateral walls of the male connector housing 11 are outer walls 21 formed integrally with the lateral walls. These outer walls laterally cover the lower halves of the lever 14 mounted on the lateral walls, respectively.

Figure 1A:
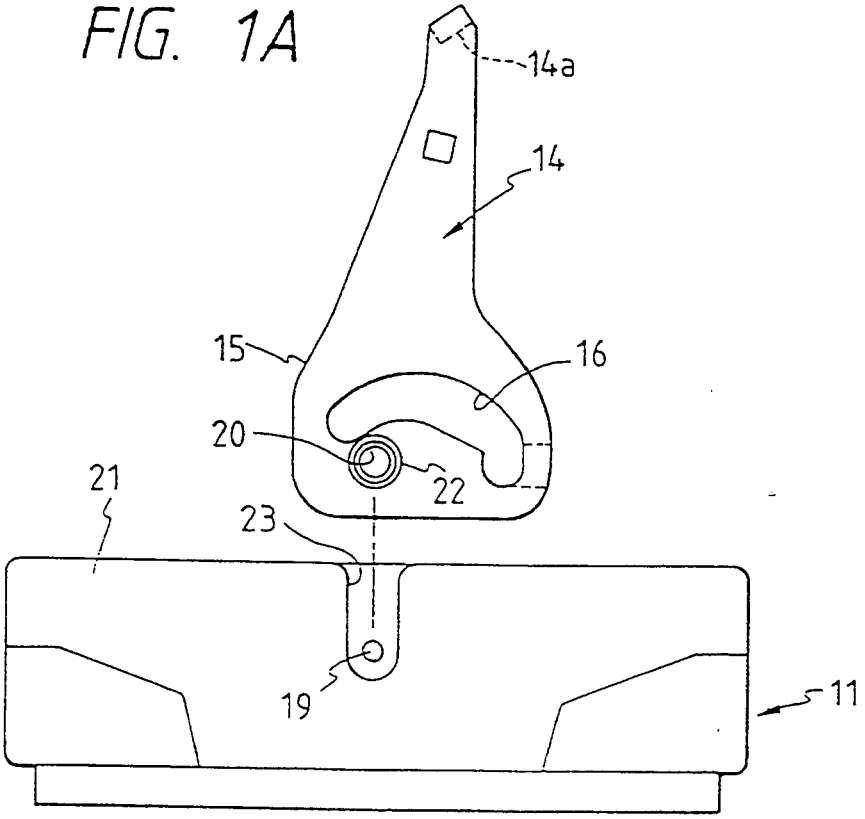
FIGS. 1(A) and (B) are side views showing an assembling process of an embodiment of the invention.
Figure 1B:
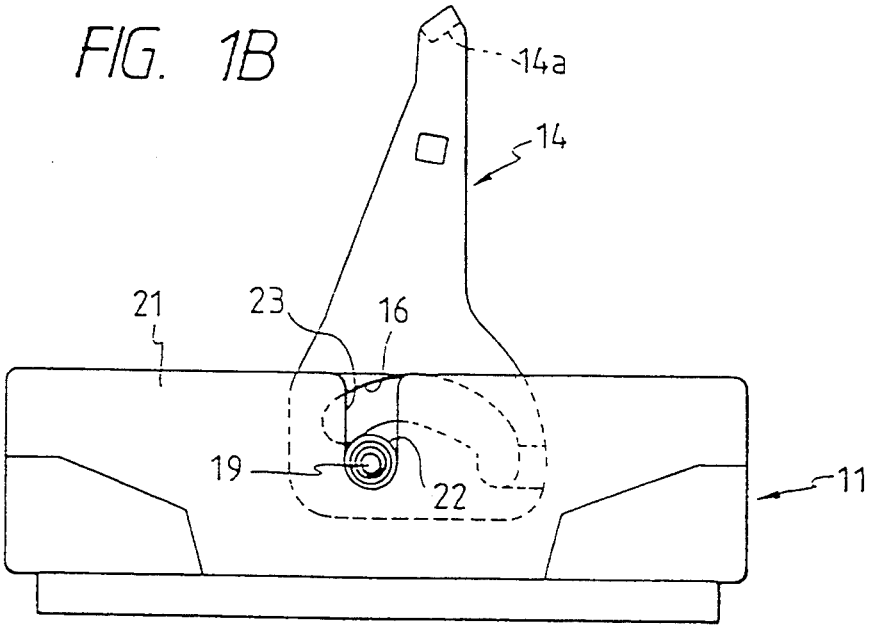
Figure 2A:
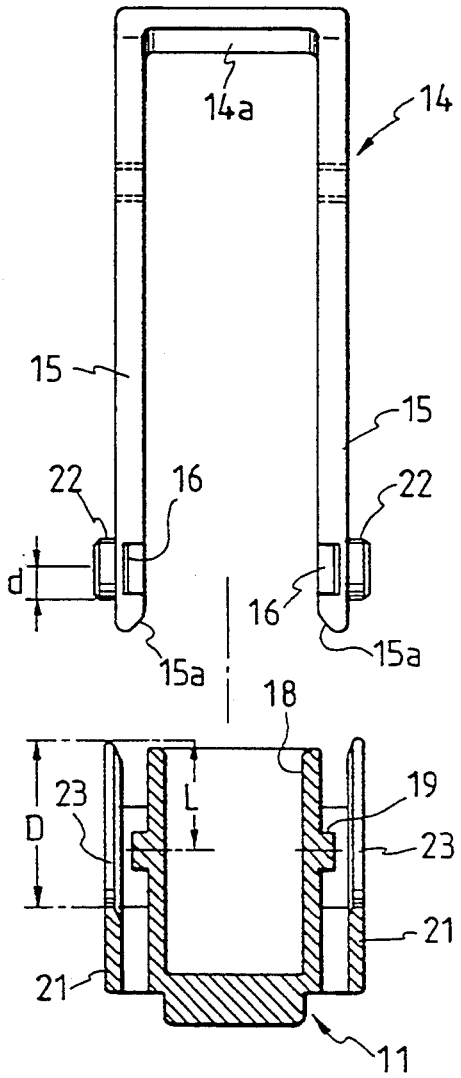
FIGS. 2(A) and (B) are longitudinal sectional views of the assembling process.

Concentrical sleeve-like regulating projections 22 project from the peripheries of the bearing holes 20 of the respective leg portions 15 of the lever 14 in such directions that the regulating projections 22 leave the lateral walls of the male connector housing 11 (see FIG. 2). On the outer walls 21 are guide grooves 23, each of which is formed so as to extend downward as viewed in FIG. 1 for allowing the corresponding regulating projection 22 to be inserted. The length of each guide groove 23 is determined in the following manner. The regulating projection 22 is designed to have such a dimensional relationship as to abut against the bottom of the guide groove 23 after the lever support shaft 19 has passed the bearing hole 20 in the lever 14 and before the lever support shaft 19 is engaged with the cam groove 16 when the lever 14 is fitted into the male connector housing 11. In this embodiment, the depth D of the guide groove 23 is determined by the following equation, assuming that the length from the upper end of the guide groove 23 to the center of the lever support shaft 19 is L and that the radius of the regulating projection 22 is d as shown in FIG. 2(A):

$$D=L+d$$

Figure 2B:
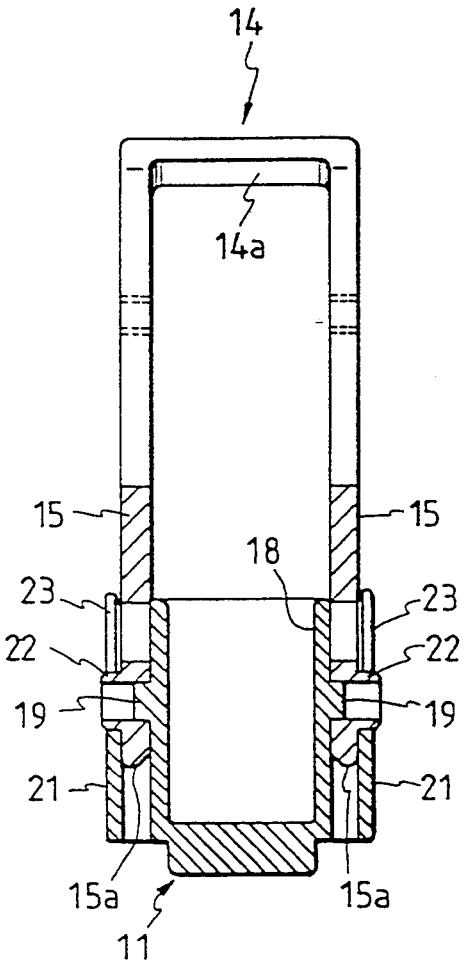
Figure 3:
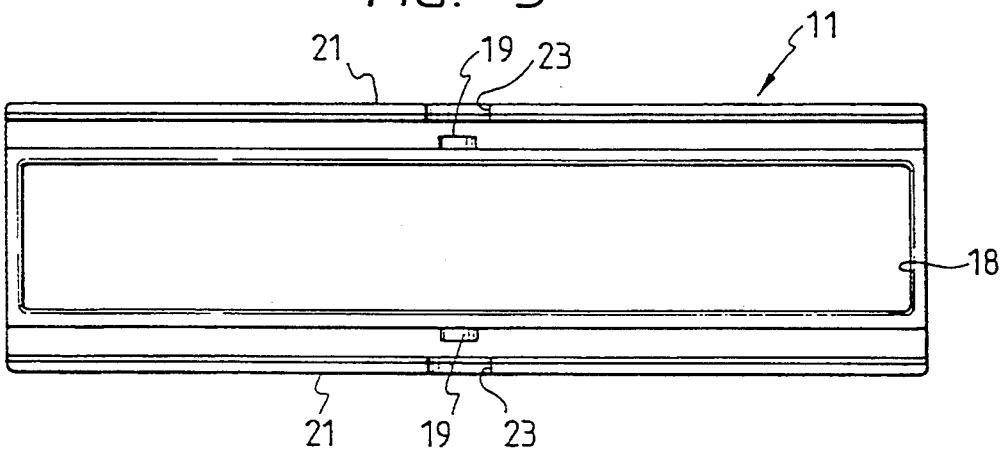
FIG. 3 is a plan view of the embodiment with male terminals of a male connector housing omitted.

In the above construction, the assembling operation is performed in the following manner. Holding the male connector housing 11 in one hand and the lever 14 in the other, the leg portions 15 of the lever 14 are inserted into the gaps between the lateral walls and the outer walls 21 of the male connector housing 11 so as to put the regulating projections 22 on the entrances of the guide grooves 23. In this condition, when the lever 14 is pushed onto the male connector housing 11, the lower edges of the leg portions 15 of the lever 14 are abutted against the lever support shafts 19. This in turn causes both leg portions 15 to elastically deform so that they open apart from each other along the tapered surfaces 15*a*. As a result, when the lever 14 is further lowered to cause the bearing holes 20 formed on the leg portions 15 to coincide with the lever support shafts 19, both leg portions 15 elastically deform to close themselves to return to the original positions, thereby allowing the lever 14 to be pivotally mounted on the male connector housing 11 with the bearing holes 20 engaged with the lever support shafts as shown in FIG. 2(B). Since the regulating projections 22 abut against the bottoms of the guide grooves 23, respectively, as is apparent from FIGS. 1 and 2, the lever 14 cannot be pushed down any farther. Therefore, even if the lever 14 is pushed down with excessive force, such pushing force is interrupted to hold the lever 14 at that position. As a result, the engagement between the lever support shafts 19 and the cam grooves 16 due to the lever 14 being pushed down by excessive force associated with the connecting operation can be prevented without fail.

As described above, according to this embodiment, even if the lever 14 is inserted into the male connector housing 11 with force, the entrance of the lever 14 farther into the male connector housing 11 can be prevented by the regulating projections 22 abutting against the bottoms of the guide grooves 23. Therefore, erroneous entrance of the lever support shafts 19 into the cam grooves 16 can be avoided. This dispenses with superfluous operations such as rectifying the insertion of the lever 14, thereby ensuring efficiency in the lever mounting operation. In addition, when the lever 14 is pushed down with the regulating projections 22 put on the entrances of the guide grooves 23, the regulating projections 22 are guided into the guide grooves 23, automatically reaching the regular inserting positions. As a result, the mounting operation is extremely simple, which provides for improved assembling efficiency. Further, since the regulating projections 22 are projected so as to be concentric with the bearing holes 20, the regulating projections 22 turn only inside the guide grooves 23 even if the lever 14 is turned. Accordingly, the regulating projections do not hamper the lever 14 from performing its essential function, which is an additional advantage. Still further, since the guide grooves 23 are formed on the outer walls 21 that are arranged to protect the lever 14, no special mechanism is added for the positional regulation of the lever 14. This means that the mold of the male connector housing 11 requires little modification, thus contributing to reduced manufacturing costs.

The present invention is not limited to the above embodiment, and for example the following modifications can be made.

(1) In the above embodiment, although the cam follower projection 17 is arranged on the cover 13 that is put on the female connector housing 12, the cam follower projection may be arranged on the female connector housing itself.

(2) The lever may be arranged on the female connector housing and the cam follower projection may be arranged on the male connector housing.

As described above, in the lever-type connector of the present invention, it is ensured that the regulating projections will prevent the lever support shafts from entering into the cam grooves. Therefore, the lever support shafts formed on the connector housing are kept from entering into the cam grooves surely, thereby providing an excellent advantage that the lever assembling operation can be performed simply as well as surely.

While the embodiments disclosed herein are preferred, it will be appreciated from this teaching that various alternatives, modifications, variations or improvements therein may be made by those skilled in the art that are within the scope of the invention, which is defined by the following claims.

What is claimed is:

1. A lever-type connector wherein a lever having cam grooves is pivotally mounted on a first connector housing and wherein a second connector housing is displaced by action of the cam grooves associated with pivotal movement of said lever so that both connectors are connected and disconnected, said lever being pivotally supported by said first connector housing by causing bearing holes formed on said lever to be engaged with lever support shafts projected from said first connector housing wherein outer walls are provided on said second connector housing, the outer walls confronting said lever from lateral sides of said second connector housing, wherein regulating projections concentric with the bearing holes are disposed on said lever such that the regulating projections are spaced from the connector housing, and wherein guide grooves are formed for receiving the regulating projections when said lever is fitted into the connector housing, a length of each guide groove being set to such a value as to cause the regulating projection to abut against a bottom of the guide groove after the lever support shaft has passed the bearing hole in said lever and before the lever support shaft enters into the cam groove.

2. A lever-type connector, wherein a lever having cam grooves is pivotally mounted between a first connector housing and a second connector housing, the second connector housing including at least one cam follower projection, the first connector housing comprising:

a rectangular hood disposed substantially about said first connector housing;

at least one lever support shaft projecting laterally from said rectangular hood, said lever being mounted on said at least one lever support shaft;

outer walls spaced from and outside of lateral walls of said first connector, said lever being mounted between said outer walls and said lateral walls; and means for preventing said at least one lever support shaft from engaging a respective one of said cam grooves.

3. A connector as claimed in claim 2, wherein said preventing means comprises:

at least one regulating projection attached to said lever; and a guide groove having a predetermined depth formed in each of said outer walls, said guide groove receiving said at least one regulating projection.

4. A connector as claimed in claim 3, wherein said predetermined depth D is determined by the following relation:

$$D=L+d$$

where L is the length from an upper end of said at least one guide groove to a center of said at least one lever support shaft and d is the radius of said at least one regulating projection.

5. A connector as claimed in claim 2, wherein said lever comprises two legs having a first end and a second end, said first end of said legs being connected by a bridge portion, each of said legs comprising a bearing hole for receiving a corresponding lever support shaft.

6. A connector according to claim 5, wherein said second end of said lever is tapered toward the inside of the lever.

7. A lever-type connector, wherein a lever having cam grooves is pivotally mounted between a first connector housing and a second connector housing, the second connector housing including at least one cam follower projection, said lever including a pair of regulating projections, the first connector comprising:

a rectangular hood disposed substantially about said first connector housing;

at least one lever support shaft projecting laterally from said rectangular hood, said lever being mounted on said at least one lever support shaft; and outer walls spaced from and outside of lateral walls of said first connector, said lever being mounted between and engaging both said outer walls and said lateral walls, wherein each of said outer walls comprises a guide groove having a predetermined depth, said guide grooves adapted to receive said regulating projections on said lever.

8. A connector as claimed in claim 7, wherein said predetermined depth D is determined by the following relation:

$$D=L+d$$

where L is the length from an upper end of said at least one guide groove to a center of said at least one lever support shaft and d is the radius of said at least one regulating projection.

9. A connector as claimed in claim 8, wherein said lever comprises two legs having a first end and a second end, said first end of said legs being connected by a bridge portion, each of said legs comprising a bearing hole for receiving a corresponding lever support shaft.

10. A connector according to claim 9, wherein said second end of said lever is tapered toward the inside of the lever.

* * * * *